US010900199B2

(12) United States Patent
Kondo et al.

(10) Patent No.: US 10,900,199 B2
(45) Date of Patent: Jan. 26, 2021

(54) DRIVE SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Takehisa Kato, Kobe (JP); Hideyasu Muraoka, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/765,135

(22) PCT Filed: Nov. 8, 2018

(86) PCT No.: PCT/JP2018/041482
§ 371 (c)(1),
(2) Date: May 18, 2020

(87) PCT Pub. No.: WO2019/098116
PCT Pub. Date: May 23, 2019

(65) Prior Publication Data

US 2020/0347575 A1 Nov. 5, 2020

(30) Foreign Application Priority Data

Nov. 17, 2017 (JP) ..... 2017-221659

(51) Int. Cl.
*F15B 21/14* (2006.01)
*E02F 9/22* (2006.01)
(Continued)

(52) U.S. Cl.
CPC ..... *E02F 9/2217* (2013.01); *E02F 3/32* (2013.01); *E02F 9/123* (2013.01); *E02F 9/2246* (2013.01);
(Continued)

(58) Field of Classification Search
CPC ..... E02F 9/2217; E02F 9/123; E02F 9/2246; F15B 21/14; F15B 11/04
See application file for complete search history.

(56) References Cited

U.S. PATENT DOCUMENTS 4,726,186 A * 2/1988 Tatsumi ..... E02F 9/2246 60/434
7,020,553 B2 * 3/2006 Nakamura ..... F02D 29/04 172/3
(Continued)

FOREIGN PATENT DOCUMENTS

JP 4024120 B2 12/2007
JP 2013-170406 A 9/2013
(Continued)

*Primary Examiner* — Abiy Teka
(74) *Attorney, Agent, or Firm* — Oliff PLC

(57) ABSTRACT

A drive system of a construction machine includes: a controller that controls a fuel injection valve, so an actual rotation speed of an engine is adjusted to a setting rotation speed; a hydraulic circuit including a boom cylinder supplied with hydraulic oil from a pump driven by the engine, configured so energy is regenerated as motive power owing to the pump being driven by pressurized oil discharged from the boom cylinder at boom lowering; and a boom operation device including a boom operation lever. At boom lowering, the controller cuts a fuel supply to the engine when a cutting condition is satisfied, which is defined to include that an operating amount of the lever is less than or equal to a first threshold, and resumes the fuel supply when the cutting condition stops being satisfied or when the actual rotation speed of the engine becomes less than a second threshold.

10 Claims, 3 Drawing Sheets

(51) Int. Cl.
*E02F 3/32* (2006.01)
*E02F 9/12* (2006.01)

(52) U.S. Cl.
CPC ..... *F15B 21/14* (2013.01); *F15B 2211/205* (2013.01)

(56) References Cited

U.S. PATENT DOCUMENTS

| | | | | |
|---|---|---|---|---|
| 9,783,960 | B2 * | 10/2017 | Shimizu | E02F 9/2278 |
| 10,221,871 | B2 * | 3/2019 | Imura | F15B 13/06 |
| 2007/0261277 | A1 * | 11/2007 | Ishikawa | E02F 9/2246 37/424 |
| 2013/0218422 | A1 | 8/2013 | Nishitani et al. | |
| 2017/0314586 | A1 * | 11/2017 | Egawa | E02F 9/2228 |

FOREIGN PATENT DOCUMENTS

| | | | |
|---|---|---|---|
| JP | 2016-017602 | A | 2/2016 |
| JP | 2016-118221 | A | 6/2016 |

* cited by examiner

DRIVE SYSTEM OF CONSTRUCTION MACHINE

TECHNICAL FIELD

The present invention relates to a drive system of a construction machine.

BACKGROUND ART

In construction machines such as hydraulic excavators and hydraulic cranes, a drive system including a hydraulic circuit and an engine is installed. The engine drives a pump included in the hydraulic circuit. For example, the hydraulic circuit includes a turning motor and a boom cylinder. The turning motor turns a turning unit, and the boom cylinder swings a boom provided on the turning unit.

For example, Patent Literature 1 discloses a drive system of a construction machine, the drive system including a hydraulic circuit configured such that energy is regenerated at turning deceleration and at boom lowering. The energy is regenerated owing to the pump being driven by pressurized oil discharged from the turning motor or the boom cylinder, and the energy is regenerated as motive power. To be more specific, the hydraulic circuit includes a regenerative motor that is coupled to the pump such that the torque of the regenerative motor is transmittable to the pump. At turning deceleration or at boom lowering, the regenerative motor is rotated by pressurized oil discharged from the turning motor or the boom cylinder.

Patent Literature 2 discloses a drive system including a plurality of hydraulic actuators, one of which is a boom cylinder. In the drive system, each of the plurality of hydraulic actuators is connected to an over-center pump in a manner to form a closed circuit. Also in this drive system, energy is regenerated owing to the pump being driven by pressurized oil discharged from the boom cylinder at boom lowering.

CITATION LIST

Patent Literature

PTL 1: Japanese Laid-Open Patent Application Publication No. 2016-118221

PTL 2: Japanese Laid-Open Patent Application Publication No. 2016-17602

SUMMARY OF INVENTION

Technical Problem

If the hydraulic circuit is configured such that energy is regenerated at turning deceleration and/or at boom lowering as in the drive systems disclosed by Patent Literatures 1 and 2, the fuel consumption of the engine can be improved. However, it is desired to further improve the fuel consumption of the engine.

In view of the above, an object of the present invention is to provide a drive system of a construction machine, the drive system making it possible to further improve the fuel consumption of the engine.

Solution to Problem

In order to solve the above-described problems, the inventors of the present invention have paid attention to the fact that during the energy regeneration, normally, fuel injection is performed in the engine in order to keep the rotation speed of the engine to a setting rotation speed. Then, the inventors have come up with the idea of cutting a fuel supply to the engine during the energy regeneration. However, in the case of an electronically controlled engine, i.e., an engine whose fuel injection amount is controlled by a controller, whether the load is large or small is estimated from a slight change in the engine rotation speed, the slight change occurring in accordance with the magnitude of the load, and the engine rotation speed is controlled to be a preset constant rotation speed. For this reason, it is difficult to determine whether the load is large or small from a change in the engine rotation speed. Moreover, even if the fuel supply to the engine is cut, the resumption of the fuel supply needs to wait until the engine rotation speed decreases to a great degree. In this case, after the fuel supply is cut, when the operator of the construction machine performs some kind of operation, there is a risk that the engine rotation speed may stall significantly or the engine may stop. Therefore, it is necessary to determine, from the outside of the engine, whether or not the load is in such a state that the engine can be driven continuously even if the fuel supply of the engine is cut. The present invention has been made from this point of view.

It should be noted that Patent Literature 2 describes cutting the fuel injection amount of the engine when the engine load power has become zero at boom lowering. This is intended to prevent the engine rotation speed from increasing beyond an allowable rotation speed. That is, the intention of the fuel cutting described in Patent Literature 2 is different from the aforementioned object of the present invention, which is to further improve the fuel consumption of the engine.

Specifically, a drive system of a construction machine according to one aspect of the present invention includes: a controller that controls a fuel injection valve provided on an engine, such that an actual rotation speed of the engine is adjusted to a setting rotation speed; a hydraulic circuit that includes a pump and a boom cylinder, the pump being driven by the engine, the boom cylinder being supplied with hydraulic oil from the pump, the hydraulic circuit being configured such that energy is regenerated as motive power owing to the pump being driven by pressurized oil discharged from the boom cylinder at boom lowering; and a boom operation device including a boom operation lever. At boom lowering, the controller cuts a fuel supply to the engine when a cutting condition at boom lowering is satisfied, the cutting condition at boom lowering being defined to include that an operating amount of the boom operation lever is greater than or equal to a first threshold, and resumes the fuel supply to the engine when the cutting condition at boom lowering stops being satisfied or when the actual rotation speed of the engine becomes less than a second threshold.

According to the above configuration, when the cutting condition at boom lowering is satisfied, the fuel supply to the engine is cut during the energy regeneration. This makes it possible to further improve the fuel consumption of the engine compared to the conventional art. Moreover, when the cutting condition at boom lowering stops being satisfied, or when the actual rotation speed of the engine becomes less than the second threshold, the fuel supply to the engine is resumed immediately, and thereby a decrease in the rotation speed of the engine can be minimized. This makes it possible to readily keep the rotation speed of the engine within such a range that the rotation speed of the engine can be immediately brought back to the setting rotation speed. Furthermore, whether or not the cutting condition at boom lowering is satisfied can be readily and precisely determined based on the operating amount of the boom operation lever.

The pump may be connected to a tank by a suction line provided with a check valve. The hydraulic circuit may include a regenerative line that leads the pressurized oil discharged from the boom cylinder at boom lowering to a portion of the suction line downstream of the check valve. According to this configuration, at boom lowering, the pressurized oil is led to the suction line through the regenerative line. This makes it possible to regenerate energy at boom lowering with a simpler structure than in the case of using a regenerative motor. That is, the space occupied by, the mass of, and the cost of the drive system are less than those in the case of using the regenerative motor.

Alternatively, the hydraulic circuit may include a regenerative motor that is coupled to the pump such that a torque of the regenerative motor is transmittable to the pump, the regenerative motor being rotated by the pressurized oil discharged from the boom cylinder at boom lowering.

The hydraulic circuit may include a turning motor that is supplied with the hydraulic oil from the pump, the hydraulic circuit being configured such that energy is regenerated as motive power owing to the pump being driven by pressurized oil discharged from the turning motor at turning deceleration. The above drive system may further include a turning operation device including a turning operation lever. At turning deceleration, the controller may cut the fuel supply to the engine when a cutting condition at turning deceleration is satisfied, the cutting condition at turning deceleration being defined to include that an operating amount of the turning operation lever is less than or equal to a third threshold, and resume the fuel supply to the engine when the cutting condition at turning deceleration stops being satisfied or when the actual rotation speed of the engine becomes less than the second threshold. According to this configuration, when the cutting condition at turning deceleration is satisfied, the fuel supply to the engine is cut during the energy regeneration. This makes it possible to further improve the fuel consumption of the engine compared to the conventional art. Moreover, when the cutting condition at turning deceleration stops being satisfied, or when the actual rotation speed of the engine becomes less than the second threshold, the fuel supply to the engine is resumed immediately, and thereby a decrease in the rotation speed of the engine can be minimized. This makes it possible to readily keep the rotation speed of the engine within such a range that the rotation speed of the engine can be immediately brought back to the setting rotation speed. Furthermore, whether or not the cutting condition at turning deceleration is satisfied can be readily and precisely determined based on the operating amount of the turning operation lever.

A drive system of a construction machine according to another aspect of the present invention includes: a controller that controls a fuel injection valve provided on an engine, such that an actual rotation speed of the engine is adjusted to a setting rotation speed; a hydraulic circuit that includes a pump and a turning motor, the pump being driven by the engine, the turning motor being supplied with hydraulic oil from the pump, the hydraulic circuit being configured such that energy is regenerated as motive power owing to the pump being driven by pressurized oil discharged from the turning motor at turning deceleration; and a turning operation device including a turning operation lever. At turning deceleration, the controller cuts a fuel supply to the engine when a cutting condition at turning deceleration is satisfied, the cutting condition at turning deceleration being defined to include that an operating amount of the turning operation lever is less than or equal to a first threshold, and resumes the fuel supply to the engine when the cutting condition at turning deceleration stops being satisfied or when the actual rotation speed of the engine becomes less than a second threshold.

According to the above configuration, when the cutting condition at turning deceleration is satisfied, the fuel supply to the engine is cut during the energy regeneration. This makes it possible to further improve the fuel consumption of the engine compared to the conventional art. Moreover, when the cutting condition at turning deceleration stops being satisfied, or when the actual rotation speed of the engine becomes less than the second threshold, the fuel supply to the engine is resumed immediately, and thereby a decrease in the rotation speed of the engine can be minimized. This makes it possible to readily keep the rotation speed of the engine within such a range that the rotation speed of the engine can be immediately brought back to the setting rotation speed. Furthermore, whether or not the cutting condition at turning deceleration is satisfied can be readily and precisely determined based on the operating amount of the turning operation lever.

For example, the cutting condition at turning deceleration may be defined to further include that a turning speed is higher than a setting value.

The controller may include an engine control unit and a pump control unit, the engine control unit controlling the fuel injection valve, the pump control unit controlling at least one device included in the hydraulic circuit, the engine control unit transmitting an actual rotation speed signal of the engine to the pump control unit. The pump control unit may: transmit a fuel supply cuttable signal to the engine control unit when the cutting condition at turning deceleration or the cutting condition at boom lowering is satisfied; and stop transmitting the fuel supply cuttable signal when the cutting condition at turning deceleration or the cutting condition at boom lowering stops being satisfied or when the actual rotation speed of the engine becomes less than the second threshold. According to this configuration, for the engine control unit, making only minor changes to part of software in a conventional engine control unit is required.

Advantageous Effects of Invention

The present invention makes it possible to further improve the fuel consumption of the engine compared to the conventional art.

DESCRIPTION OF EMBODIMENTS

Embodiment 1

Figure 1:
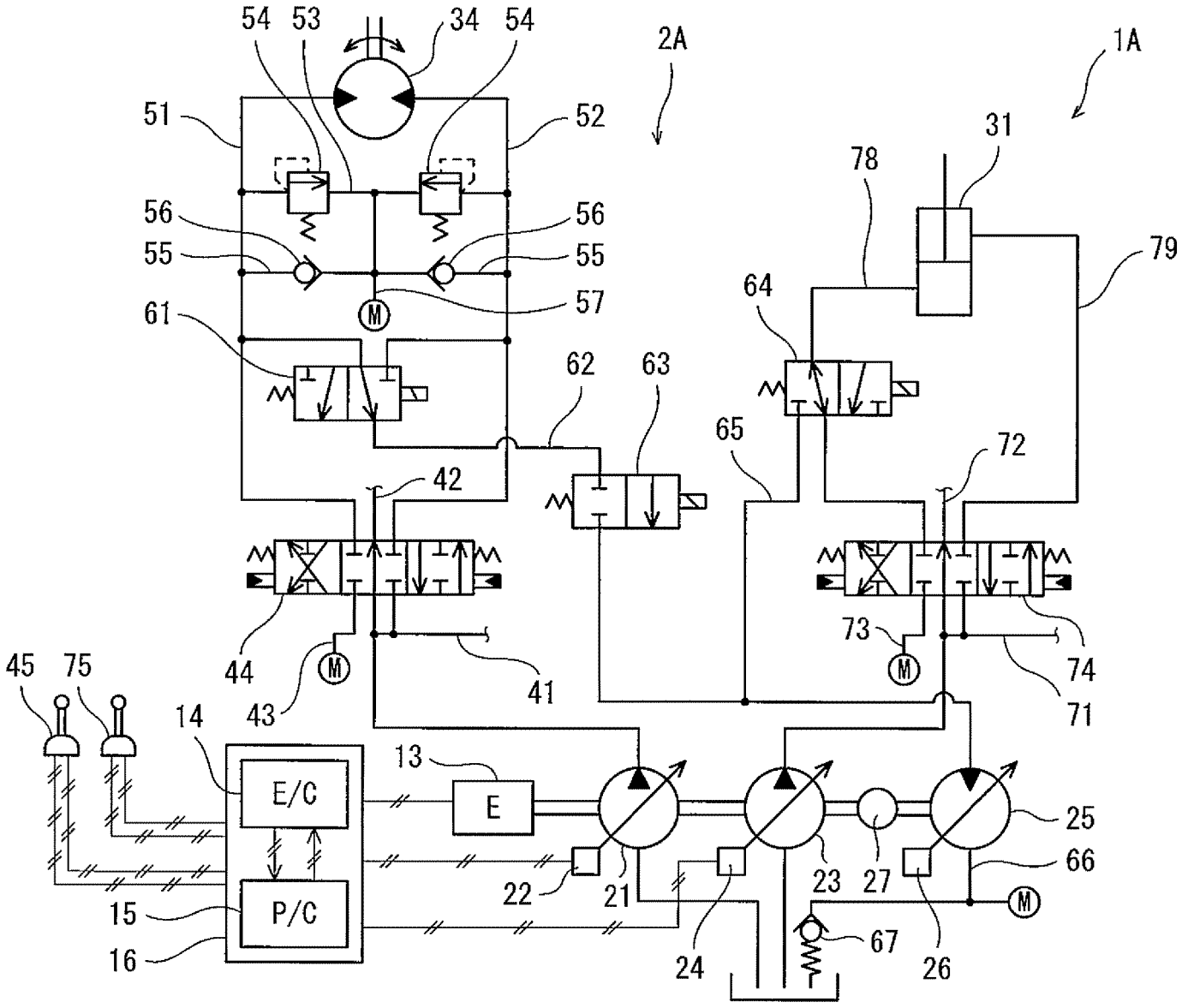
FIG. 1 shows a schematic configuration of a drive system of a construction machine according to Embodiment 1 of the present invention.
Figure 2:
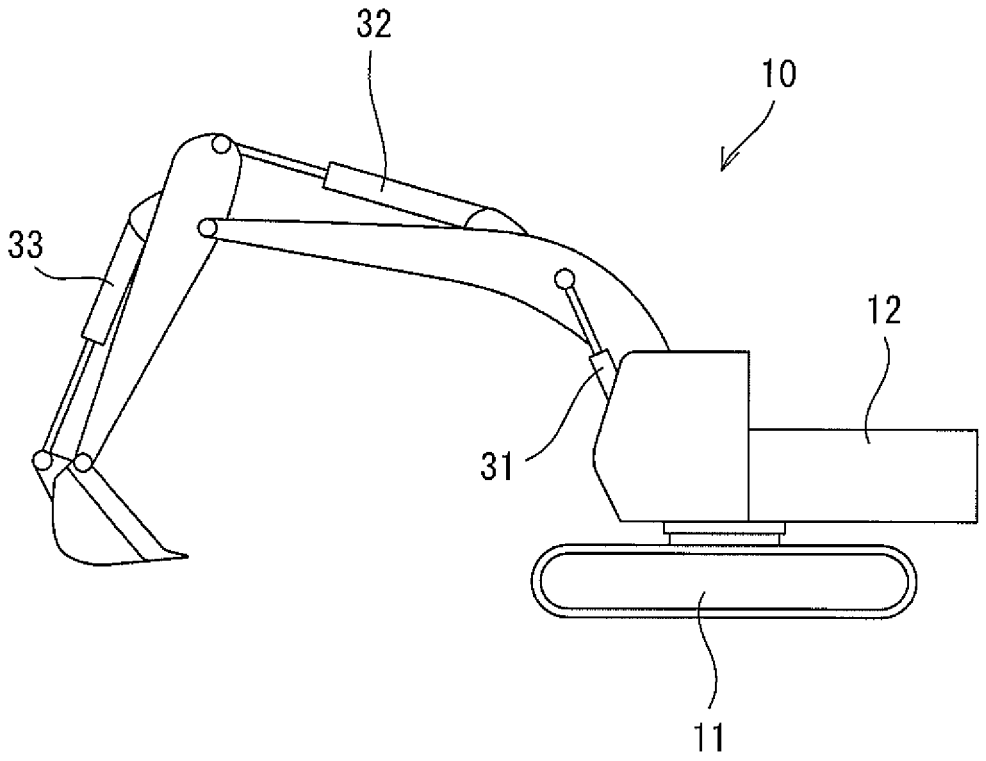
FIG. 2 is a side view of a hydraulic excavator that is one example of the construction machine.

FIG. 1 shows a drive system 1A of a construction machine according to Embodiment 1 of the present invention. FIG. 2 shows a construction machine 10, in which the drive system 1A is installed. Although the construction machine 10 shown in FIG. 2 is a hydraulic excavator, the present invention is applicable to other construction machines, such as a hydraulic crane.

The construction machine 10 shown in FIG. 2 is of a self-propelled type. The construction machine 10 includes: a running unit 11; and a turning unit 12 turnably supported by the running unit 11. The turning unit 12 is equipped with a boom that is swingable. An arm is swingably coupled to the distal end of the boom, and a bucket is swingably coupled to the distal end of the arm. However, the construction machine 10 need not be of a self-propelled type.

The drive system 1A includes a hydraulic circuit 2A and an engine 13. The hydraulic circuit 2A includes, as hydraulic actuators, a boom cylinder 31, an arm cylinder 32, and a bucket cylinder 33, which are shown in FIG. 2, a turning motor 34 shown in FIG. 1, an unshown left running motor, and an unshown right running motor. The turning motor 34 turns the turning unit 12. The boom cylinder 31, the arm cylinder 32, and the bucket cylinder 33 swing the boom, the arm, and the bucket, respectively.

As shown in FIG. 1, the hydraulic circuit 2A further includes a first pump 21 and a second pump 23, which supply hydraulic oil to the aforementioned hydraulic actuators. It should be noted that, in FIG. 1, the hydraulic actuators other than the turning motor 34 and the boom cylinder 31 are not shown for the purpose of simplifying the drawing.

The engine 13 drives the first pump 21 and the second pump 23. Although not illustrated, the engine 13 is provided with a plurality of fuel injection valves, and these fuel injection valves are controlled by an engine control unit 14. For example, the engine control unit 14 is a computer including a CPU and memories such as a ROM and RAM. The CPU executes a program stored in the ROM.

The engine control unit 14 is electrically connected to a rotation speed selector and a rotation speed meter that are not shown. An operator selects one of a plurality of setting rotation speeds, and the rotation speed selector receives the selected setting rotation speed. The rotation speed meter detects an actual rotation speed of the engine 13. The engine control unit 14 controls the fuel injection valves, such that the actual rotation speed of the engine 13 is adjusted to the selected setting rotation speed.

Each of the first pump 21 and the second pump 23 is a variable displacement pump (swash plate pump or bent axis pump) whose tilting angle is changeable. The tilting angle of the first pump 21 is adjusted by a first regulator 22, and the tilting angle of the second pump 23 is adjusted by a second regulator 24.

In the present embodiment, the delivery flow rate of each of the first pump 21 and the second pump 23 is controlled by electrical positive control. Accordingly, each of the first regulator 22 and the second regulator 24 moves in accordance with an electrical signal. For example, in a case where the pump (21 or 23) is a swash plate pump, the regulator (22 or 24) may electrically change the hydraulic pressure applied to a servo piston coupled to the swash plate of the pump, or may be an electric actuator coupled to the swash plate of the pump.

The first pump 21 supplies the hydraulic oil to a plurality of first hydraulic actuators including the turning motor 34 and the arm cylinder 32 via a plurality of first control valves including a turning control valve 44 (in FIG. 1, the first control valves other than the turning control valve 44 are not shown). The second pump 23 supplies the hydraulic oil to a plurality of second hydraulic actuators including the boom cylinder 31 and the bucket cylinder 33 via a plurality of second control valves including a boom control valve 74 (in FIG. 1, the second control valves other than the boom control valve 74 are not shown). It should be noted that at least one of the first hydraulic actuators and at least one of the second hydraulic actuators may be the same. For example, both the first pump 21 and the second pump 23 may supply the hydraulic oil to the boom cylinder 31.

Specifically, the first pump 21 is connected to the plurality of first control valves by a first supply line 41. In the present embodiment, upstream of all the first control valves, a center bypass line 42 is branched off from the first supply line 41. The center bypass line 42 passes through all the first control valves, and connects to a tank (in the drawing, the downstream portion of the center bypass line 42 is omitted).

Similarly, the second pump 23 is connected to the plurality of second control valves by a second supply line 71. In the present embodiment, upstream of all the second control valves, a center bypass line 72 is branched off from the second supply line 71. The center bypass line 72 passes through all the second control valves, and connects to the tank (in the drawing, the downstream portion of the center bypass line 72 is omitted).

The turning control valve 44 controls the supply and discharge of the hydraulic oil to and from the turning motor 34. Specifically, the turning control valve 44 is connected to the turning motor 34 by a left turning supply line 51 and a right turning supply line 52. A tank line 43 is connected to the turning control valve 44.

The left turning supply line 51 and the right turning supply line 52 are connected to each other by a bridging passage 53. The bridging passage 53 is provided with a pair of relief valves 54, which are directed opposite to each other. A portion of the bridging passage 53 between the relief valves 54 is connected to the tank by a make-up line 57. Each of the left turning supply line 51 and the right turning supply line 52 is connected to the make-up line 57 by a corresponding one of bypass lines 55. Alternatively, the pair of bypass lines 55 may be provided on the bridging passage 53 in a manner to bypass the pair of relief valves 54, respectively. The bypass lines 55 are provided with check valves 56, respectively.

In the present embodiment, the turning control valve 44 includes a pair of pilot ports. Alternatively, the turning control valve 44 may be a solenoid pilot-type valve. As a result of a turning operation lever of a turning operation device 45 being inclined in a left turning direction or a right turning direction, the turning control valve 44 shifts from its neutral position to a left turning position or a right turning position.

The turning operation device 45 outputs a turning operation signal (left turning operation signal or right turning operation signal) corresponding to the inclination angle of the turning operation lever. In the present embodiment, the turning operation signal outputted from the turning operation device 45 increases in accordance with increase in the inclination angle of the turning operation lever.

In the present embodiment, the turning operation device 45 is an electrical joystick that outputs an electrical signal as the turning operation signal. Accordingly, solenoid proportional valves (not shown) are connected to the respective pilot ports of the turning control valve 44. These solenoid proportional valves are controlled by a pump control unit 15, which will be described below. Alternatively, the turning operation device 45 may be a pilot operation valve that outputs a pilot pressure as the turning operation signal. In this case, the turning operation device 45 is connected to the pilot ports of the turning control valve 44 by a pair pilot lines 46 and 47.

The boom control valve 74 controls the supply and discharge of the hydraulic oil to and from the boom cylinder 31. Specifically, the boom control valve 74 is connected to the boom cylinder 31 by a boom raising supply line 78 and a boom lowering supply line 79. A tank line 73 is connected to the boom control valve 74.

In the present embodiment, the boom control valve 74 includes a pair of pilot ports. Alternatively, the boom control valve 74 may be a solenoid pilot-type valve. As a result of a boom operation lever of a boom operation device 75 being inclined in a boom raising direction or a boom lowering direction, the boom control valve 74 shifts from its neutral position to a boom raising position or a boom lowering position.

The boom operation device 75 outputs a boom operation signal (boom raising operation signal or boom lowering operation signal) corresponding to the inclination angle of the boom operation lever. In the present embodiment, the boom operation signal outputted from the boom operation device 75 increases in accordance with increase in the inclination angle of the boom operation lever.

In the present embodiment, the boom operation device 75 is an electrical joystick that outputs an electrical signal as the boom operation signal. Accordingly, solenoid proportional valves (not shown) are connected to the respective pilot ports of the boom control valve 74. These solenoid proportional valves are controlled by the pump control unit 15, which will be described below. Alternatively, the boom operation device 75 may be a pilot operation valve that outputs a pilot pressure as the boom operation signal. In this case, the boom operation device 75 is connected to the pilot ports of the boom control valve 74 by a pair of pilot lines 76 and 77.

The downstream-side portion of the tank line 43 connected to the turning control valve 44, the downstream-side portion of the tank line 73 connected to the boom control valve 74, and the tank-side portion of the make-up line 57 merge together forming a single merged passage. The merged passage is provided with a check valve 67 whose cracking pressure is set slightly high.

The turning operation signal outputted from the turning operation device 45 and the boom operation signal outputted from the boom operation device 75 are inputted into the pump control unit 15. The pump control unit 15 and the aforementioned engine control unit 14 constitute a controller 16. For example, the pump control unit 15 is a computer including a CPU and memories such as a ROM and RAM. The CPU executes a program stored in the ROM.

When the turning operation signal (left turning operation signal or right turning operation signal) is outputted from the turning operation device 45, the pump control unit 15 controls a corresponding one of the unshown solenoid proportional valves connected to the pilot ports of the turning control valve 44, such that the secondary pressure of the corresponding solenoid proportional valve increases in accordance with increase in the turning operation signal. Also, when the boom operation signal (boom raising operation signal or boom lowering operation signal) is outputted from the boom operation device 75, the pump control unit 15 controls a corresponding one of the unshown solenoid proportional valves connected to the pilot ports of the boom control valve 74, such that the secondary pressure of the corresponding solenoid proportional valve increases in accordance with increase in the boom operation signal.

The pump control unit 15 also controls the aforementioned first regulator 22 and second regulator 24. The pump control unit 15 controls the first regulator 22, such that the delivery flow rate of the first pump 21 increases in accordance with increase in the turning operation signal. Also, the pump control unit 15 controls the second regulator 24, such that the delivery flow rate of the second pump 23 increases in accordance with increase in the boom operation signal.

Further, in the present embodiment, the hydraulic circuit 2A is configured such that energy is regenerated at turning deceleration and at boom lowering. The energy is regenerated owing to the first pump 21 and the second pump 23 being driven by pressurized oil discharged from the turning motor 34 or the boom cylinder 31, and the energy is regenerated as motive power.

As a configuration for the energy regeneration, the hydraulic circuit 2A includes a regenerative motor 25, a turning regenerative switching valve 63, and a boom regenerative switching valve 64. Alternatively, the hydraulic circuit 2A may include only one of the turning regenerative switching valve 63 and the boom regenerative switching valve 64, and the energy regeneration may be performed only at turning deceleration or only at boom lowering.

At turning deceleration, when a cutting condition at turning deceleration is satisfied, the controller 16 cuts a fuel supply to the engine 13. Thereafter, when the cutting condition at turning deceleration stops being satisfied, or when the actual rotation speed of the engine 13 becomes less than a threshold $\alpha$, the controller 16 resumes the fuel supply to the engine 13. For example, the threshold $\alpha$ is set within the range of 50 to 100% of the setting rotation speed selected by the unshown rotation speed selector.

The cutting condition at turning deceleration is defined to include that the operating amount of the turning operation lever is less than or equal to a threshold $\beta$. For example, the cutting condition at turning deceleration may be defined to not only include that the operating amount of the turning operation lever is less than or equal to the threshold $\beta$, but further include that the turning speed of the turning unit 12 is higher than a setting value. Alternatively, the cutting condition at turning deceleration may be defined to only include that the operating amount of the turning operation lever is less than or equal to the threshold $\beta$.

Whether or not the operating amount of the turning operation lever is less than or equal to the threshold $\beta$ is determined by comparing the turning operation signal outputted from the turning operation device 45 with a value corresponding to the threshold $\beta$. For example, the threshold $\beta$ is 3 to 80% of the maximum value of the operating amount of the turning operation lever.

A switching valve 61 for selecting one of the left turning supply line 51 and the right turning supply line 52 is provided between the left turning supply line 51 and the right turning supply line 52. In the present embodiment, the switching valve 61 is a solenoid valve. Alternatively, the switching valve 61 may simply be a high pressure selective valve. The switching valve 61 is connected to the regenerative motor 25 by a turning regenerative line 62. The turning regenerative switching valve 63 is provided on the turning regenerative line 62.

The turning regenerative switching valve 63 is switched between a non-regenerative position and a regenerative position. When the turning regenerative switching valve 63 is in the non-regenerative position, the turning regenerative switching valve 63 blocks the upstream-side portion and the downstream-side portion of the turning regenerative line 62. When the turning regenerative switching valve 63 is in the regenerative position, the turning regenerative switching valve 63 brings the upstream-side portion of the turning regenerative line 62 into communication with the downstream-side portion of the turning regenerative line 62. The switching valve 61 and the turning regenerative switching valve 63 are controlled by the pump control unit 15. It should be noted that FIG. 1 shows only part of signal lines for simplifying the drawing.

When a left turning operation is performed (i.e., when a left turning operation signal is outputted from the turning operation device 45), the pump control unit 15 switches the switching valve 61 to a first position (left-side position in FIG. 1) in which the switching valve 61 brings the discharge-side right turning supply line 52 into communication with the turning regenerative line 62. When a right turning operation is performed (i.e., when a right turning operation signal is outputted from the turning operation device 45), the pump control unit 15 switches the switching valve 61 to a second position (right-side position in FIG. 1) in which the switching valve 61 brings the discharge-side left turning supply line 51 into communication with the turning regenerative line 62.

At left turning deceleration and at right turning deceleration (i.e., in the present embodiment, when the turning operation signal outputted from the turning operation device 45 decreases), the pump control unit 15 switches the turning regenerative switching valve 63 to the regenerative position. Except at left turning deceleration and at right turning deceleration, the pump control unit 15 keeps the turning regenerative switching valve 63 in the non-regenerative position. That is, at left turning deceleration and at right turning deceleration, the pressurized oil discharged from the turning motor 34 is led to the regenerative motor 25 through the turning regenerative line 62.

It should be noted that, at turning deceleration, a reverse lever operation may be performed. For example, at left turning deceleration, the turning operation lever of the turning operation device 45 may be not brought back to the neutral state from the left turning direction, but inclined in the right turning direction beyond the neutral state.

At boom lowering, when a cutting condition at boom lowering is satisfied, the controller 16 cuts a fuel supply to the engine 13. Thereafter, when the cutting condition at boom lowering stops being satisfied, or when the actual rotation speed of the engine 13 becomes less than the threshold $\alpha$, the controller 16 resumes the fuel supply to the engine 13.

The cutting condition at boom lowering is defined to include that the operating amount of the boom operation lever is greater than or equal to a threshold $\gamma$. The cutting condition at boom lowering may be defined to only include that the operating amount of the boom operation lever is greater than or equal to the threshold $\gamma$, or may be defined to further include other conditions.

Whether or not the operating amount of the boom operation lever is greater than or equal to the threshold $\gamma$ is determined by comparing the boom operation signal outputted from the boom operation device 75 with a value corresponding to the threshold $\gamma$. For example, the threshold $\gamma$ is 3 to 80% of the maximum value of the operating amount of the boom operation lever.

The boom regenerative switching valve 64 is provided on the boom raising supply line 78. The boom regenerative switching valve 64 is connected to the regenerative motor 25 by a boom regenerative line 65. In the present embodiment, the downstream-side portion of the turning regenerative line 62 and the downstream-side portion of the boom regenerative line 65 merge together forming a single merged passage. The regenerative motor 25 is connected to the tank by a tank line 66. The downstream-side portion of the tank line 66 merges with the aforementioned merged passage provided with the check valve 67.

The boom regenerative switching valve 64 is switched between a non-regenerative position and a regenerative position. When the boom regenerative switching valve 64 is in the non-regenerative position, the boom regenerative switching valve 64 brings the cylinder-side portion of the boom raising supply line 78 into communication with the control valve-side portion of the boom raising supply line 78, and blocks the boom regenerative line 65. When the boom regenerative switching valve 64 is in the regenerative position, the boom regenerative switching valve 64 brings the cylinder-side portion of the boom raising supply line 78 into communication with the boom regenerative line 65, and blocks the control valve-side portion of the boom raising supply line 78. The boom regenerative switching valve 64 is controlled by the pump control unit 15.

At boom lowering (i.e., when a boom lowering operation signal is outputted from the boom operation device 75), the pump control unit 15 switches the boom regenerative switching valve 64 to the regenerative position. Except at boom lowering, the pump control unit 15 keeps the boom regenerative switching valve 64 in the non-regenerative position. That is, at boom lowering, the pressurized oil discharged from the boom cylinder 31 is led to the regenerative motor 25 through the boom regenerative line 65.

The regenerative motor 25 is coupled to the first pump 21 and the second pump 23, such that the torque of the regenerative motor 25 is transmittable to the first pump 21 and the second pump 23. In the present embodiment, the regenerative motor 25 is coupled to the first pump 21 and the second pump 23 via a one-way clutch 27. The one-way clutch 27 allows the transmission of the torque from the regenerative motor 25 to the first pump 21 and second pump 23 only when the rotation speed of the regenerative motor 25 is higher than the rotation speed of the first pump 21 and the rotation speed of the second pump 23. That is, when the rotation speed of the regenerative motor 25 is not higher than the rotation speed of the first pump 21 and the rotation speed of the second pump 23, the one-way clutch 27 does not allow the transmission of the torque from the regenerative motor 25 to the first pump 21 and second pump 23.

As described above, at turning deceleration, the pressurized oil discharged from the turning motor 34 is led to the regenerative motor 25, and at boom lowering, the pressurized oil discharged from the boom cylinder 31 is led to the regenerative motor 25. In other words, at turning deceleration, the regenerative motor 25 is rotated by the pressurized oil discharged from the turning motor 34, and at boom lowering, the regenerative motor 25 is rotated by the pressurized oil discharged from the boom cylinder 31. Accordingly, the first pump 21 and the second pump 23 are driven.

In the present embodiment, the regenerative motor 25 is a variable displacement motor (swash plate motor or bent axis motor) whose tilting angle is changeable. Alternatively, the regenerative motor 25 may be a fixed displacement motor. The tilting angle of the regenerative motor 25 is adjusted by a third regulator 26.

In the present embodiment, the third regulator 26 moves in accordance with an electrical signal. For example, in a case where the regenerative motor 25 is a swash plate motor, the third regulator 26 may electrically change the hydraulic pressure applied to a servo piston coupled to the swash plate of the motor, or may be an electric actuator coupled to the swash plate of the motor.

The third regulator 26 is controlled by the pump control unit 15. For example, at turning deceleration, the pump control unit 15 controls the third regulator 26, such that the tilting angle of the regenerative motor 25 decreases in accordance with decrease in the turning speed of the turning unit 12. At boom lowering, the pump control unit 15 controls the third regulator 26, such that the tilting angle of the regenerative motor 25 increases in accordance with increase in the boom operation signal outputted from the boom operation device 75 (in other words, the more the operator tries to increase the boom lowering speed, the greater the tilting angle of the regenerative motor 25 becomes).

The pump control unit 15 and the engine control unit 14, which constitute the controller 16, transmit and receive signals to and from each other. Specifically, the engine control unit 14 transmits, to the pump control unit 15, an actual rotation speed signal containing information about the actual rotation speed of the engine 13. On the other hand, when the cutting condition at turning deceleration or the cutting condition at boom lowering is satisfied, the pump control unit 15 transmits a fuel supply cuttable signal to the engine control unit 14. Upon receiving the fuel supply cuttable signal, the engine control unit 14 controls the fuel injection valves to stop the fuel injection.

After transmitting the fuel supply cuttable signal to the engine control unit 14, the pump control unit 15 stops transmitting the fuel supply cuttable signal when the cutting condition at turning deceleration or the cutting condition at boom lowering stops being satisfied, or when the actual rotation speed of the engine 13 becomes less than the threshold $\alpha$. When the transmission of the fuel supply cuttable signal is stopped, the engine control unit 14 controls the fuel injection valves to resume the fuel injection.

As described above, in the drive system 1A of the present embodiment, when the cutting condition at turning deceleration or the cutting condition at boom lowering is satisfied, the fuel supply to the engine 13 is cut during the energy regeneration. This makes it possible to further improve the fuel consumption of the engine 13 compared to the conventional art. Moreover, when the cutting condition at turning deceleration or the cutting condition at boom lowering stops being satisfied, or when the actual rotation speed of the engine 13 becomes less than the threshold $\alpha$, the fuel supply to the engine 13 is resumed immediately, and thereby a decrease in the rotation speed of the engine 13 can be minimized. This makes it possible to readily keep the rotation speed of the engine 13 within such a range that the rotation speed of the engine 13 can be immediately brought back to the setting rotation speed. Furthermore, whether or not the cutting condition at turning deceleration or the cutting condition at boom lowering is satisfied can be readily and precisely determined based on the operating amount of the turning operation lever or the boom operation lever.

Still further, in the present embodiment, the engine control unit 14 and the pump control unit 15 transmit and receive signals to and from each other. Therefore, for the engine control unit 14, making only minor changes to part of software in a conventional engine control unit is required.

Embodiment 2

Figure 3:
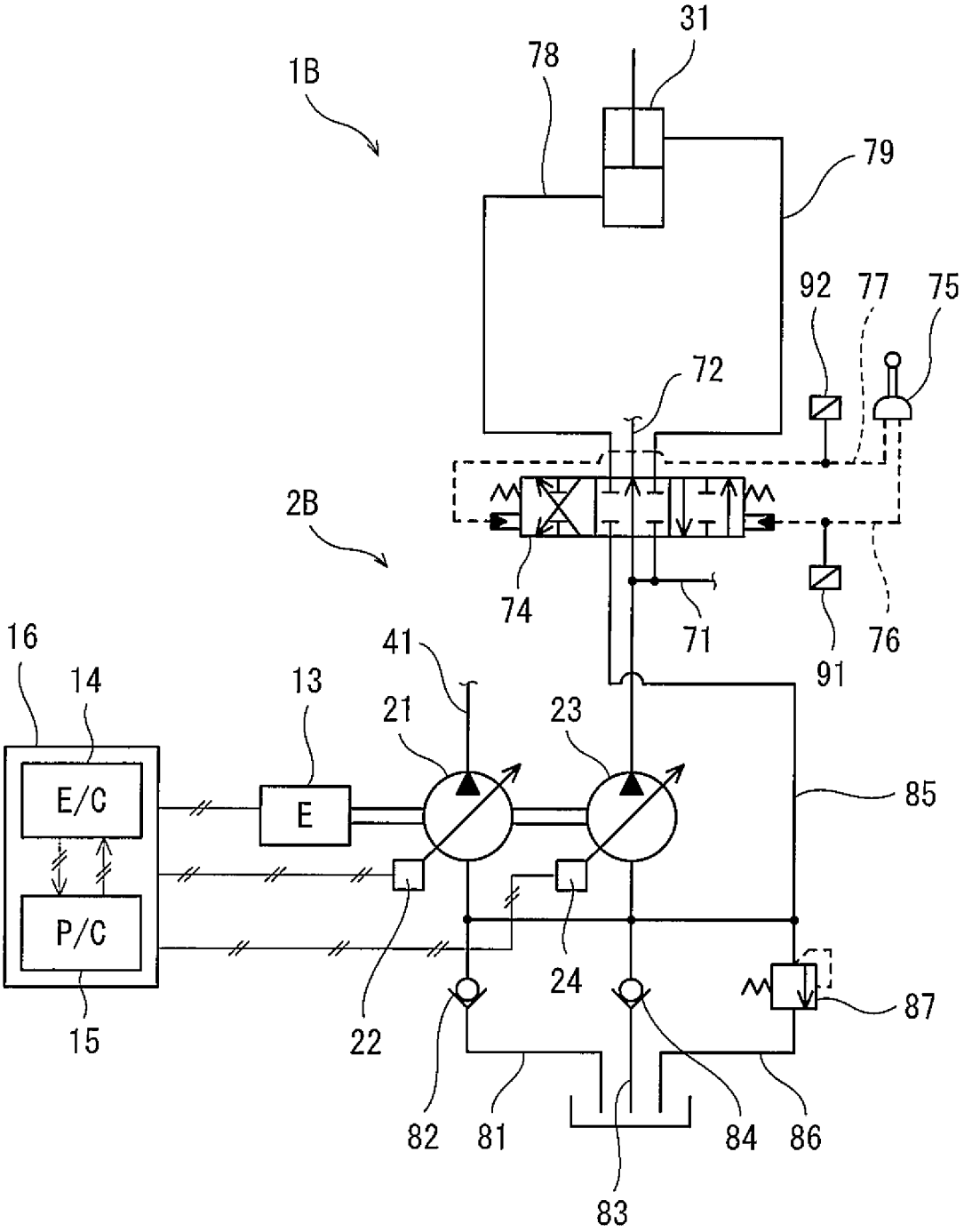
FIG. 3 shows a schematic configuration of a drive system of a construction machine according to Embodiment 2 of the present invention.

FIG. 3 shows a drive system 1B of a construction machine according to Embodiment 2 of the present invention. It should be noted that, in the present embodiment, the same components as those described in Embodiment 1 are denoted by the same reference signs as those used in Embodiment 1, and repeating the same descriptions is avoided.

The drive system 1B of the present embodiment includes a hydraulic circuit 2B, which is configured such that energy is regenerated as motive power owing to the first pump 21 or the second pump 23 being driven by the pressurized oil discharged from the boom cylinder 31 at boom lowering.

Specifically, in the present embodiment, the first pump 21 is connected to the tank by a first suction line 81 provided with a check valve 82, and the second pump 23 is connected to the tank by a second suction line 83 provided with a check valve 84. Further, in the present embodiment, instead of the tank line 73 (see FIG. 1), a regenerative line 85 is connected to the boom control valve 74.

When the boom control valve 74 is in the boom raising position, the regenerative line 85 communicates with the boom lowering supply line 79, and when the boom control valve 74 is in the boom lowering position, the regenerative line 85 communicates with the boom raising supply line 78. That is, both at boom raising and at boom lowering, the hydraulic oil (at boom lowering, the pressurized oil) discharged from the boom cylinder 31 flows through the regenerative line 85.

The regenerative line 85 is connected to a portion of the first suction line 81 downstream of the check valve 82 and to a portion of the second suction line 83 downstream of the check valve 84. That is, at boom raising and at boom lowering, the regenerative line 85 leads the hydraulic oil discharged from the boom cylinder 31 to the portion of the first suction line 81 downstream of the check valve 82 and to the portion of the second suction line 83 downstream of the check valve. Alternatively, the regenerative line 85 may be connected to only one of the portion of the first suction line 81 downstream of the check valve 82 and the portion of the second suction line 83 downstream of the check valve 84. The regenerative line 85 is connected to the tank by a relief line 86 provided with a relief valve 87.

At boom lowering, if the flow rate of the hydraulic oil discharged from the boom cylinder 31 is higher than the sum of the delivery flow rate of the first pump 21 and the delivery flow rate of the second pump 23, the suction pressure of the first pump 21 and the suction pressure of the second pump 23 are kept to the setting pressure of the relief valve 87. Accordingly, the first pump 21 and the second pump 23 are driven.

Further, in the present embodiment, the boom operation device 75 is a pilot operation valve that outputs a pilot pressure as the boom operation signal. For this reason, the boom operation device 75 is connected to the pilot ports of the boom control valve 74 by the pair of pilot lines 76 and 77. Alternatively, the boom operation device 75 may be an electrical joystick that outputs an electrical signal as the boom operation signal. In this case, solenoid proportional valves may be connected to the respective pilot ports of the boom control valve 74, or the boom control valve 74 may be a solenoid pilot-type valve.

Still further, in the present embodiment, the pump control unit 15 is electrically connected to pressure sensors 91 and 92, each of which detects the pilot pressure serving as the boom operation signal. It should be noted that FIG. 3 shows only part of signal lines for simplifying the drawing. When the pressure detected by the pressure sensor 92 is higher than zero, the pump control unit 15 determines that boom raising has been performed, and when the pressure detected by the pressure sensor 91 is higher than zero, the pump control unit 15 determines that boom lowering has been performed.

In the present embodiment, similar to Embodiment 1, at boom lowering, the controller 16 cuts the fuel supply to the engine 13 when the cutting condition at boom lowering is satisfied. Thereafter, when the cutting condition at boom lowering stops being satisfied, or when the actual rotation speed of the engine 13 becomes less than the threshold $\alpha$, the controller 16 resumes the fuel supply to the engine 13.

The present embodiment provides the same advantageous effects as those provided by Embodiment 1. In addition, in the present embodiment, at boom lowering, the pressurized oil is led to the first suction line 81 and the second suction line 83 through the regenerative line 85. This makes it possible to regenerate energy at boom lowering with a simpler structure than in the case of using the regenerative motor 25 (see FIG. 1). That is, the space occupied by, the mass of, and the cost of the drive system are less than those in the case of using the regenerative motor 25.

Other Embodiments

The present invention is not limited to the above-described embodiments. Various modifications can be made without departing from the scope of the present invention.

For example, in Embodiment 1, the delivery flow rate of the first pump 21 and the delivery flow rate of the second pump 23 may be controlled by hydraulic negative control. In this case, since each of the first regulator 22 and the second regulator 24 moves in accordance with hydraulic pressure, the pump control unit 15 may control only the valves 61, 63, and 64 (in a case where the turning operation device 45 and the boom operation device 75 are pilot operation valves). That is, the pump control unit 15 is only required to control at least one device included in the hydraulic circuit 2A. Alternatively, in Embodiment 1, the delivery flow rate of the first pump 21 and the delivery flow rate of the second pump 23 may be controlled by load-sensing control.

Similarly, also in Embodiment 2, the delivery flow rate of the first pump 21 and the delivery flow rate of the second pump 23 may be controlled by hydraulic negative control, or may be controlled by load-sensing control.

Further, in Embodiment 2, similar to Embodiment 1, a tank line may be connected to the boom control valve 74, and the regenerative line 85 may be connected to the regenerative switching valve 64 provided on the boom raising supply line 78. That is, only at boom lowering, the regenerative line 85 may lead the pressurized oil discharged from the boom cylinder 31 to the portion of the first suction line 81 downstream of the check valve 82 and to the portion of the second suction line 83 downstream of the check valve.

Alternatively, in Embodiment 2, a regenerative switching valve may be provided on the regenerative line 85 at a position upstream of a branch point where the relief line 86 is branched off from the regenerative line 85. A bypass line that bypasses the relief valve 87 may be connected to the regenerative switching valve. At boom raising, the regenerative switching valve brings the upstream-side portion of the regenerative line 85 into communication with the bypass line. At boom lowering, the regenerative switching valve brings the upstream-side portion of the regenerative line 85 into communication with the downstream-side portion of the regenerative line 85. Accordingly, at boom raising, the hydraulic oil discharged from the boom cylinder 31 is not directly sucked into the first pump 21 and the second pump 23, but returned to the tank through the bypass line.

Further, in Embodiment 1 or Embodiment 2, instead of each of the center bypass lines 42 and 72, an unloading line that does not pass through the control valves and an unloading valve provided on the unloading line may be adopted.

Still further, in Embodiment 1 or Embodiment 2, the second pump 23 may be eliminated, and the hydraulic oil may be supplied from the first pump 21 to all the hydraulic actuators.

Alternatively, the hydraulic circuit (2A or 2B) may include an over-center pump dedicated for the turning motor 34, and the over-center pump and the turning motor 34 may be connected in a manner to form a closed circuit.

REFERENCE SIGNS LIST

1A, 1B drive system
10 construction machine
13 engine
14 engine control unit
15 pump control unit
16 controller
2A, 2B hydraulic circuit
21, 23 pump
25 regenerative motor
31 boom cylinder
34 turning motor
62, 65, 85 regenerative line
81, 83 suction line
82, 84 check valve

The invention claimed is:

1. A drive system of a construction machine, comprising:

a controller that controls a fuel injection valve provided on an engine, such that an actual rotation speed of the engine is adjusted to a setting rotation speed;

a hydraulic circuit that includes a pump and a boom cylinder, the pump being driven by the engine, the boom cylinder being supplied with hydraulic oil from the pump, the hydraulic circuit being configured such that energy is regenerated as motive power owing to the pump being driven by pressurized oil discharged from the boom cylinder at boom lowering; and a boom operation device including a boom operation lever, wherein at boom lowering, the controller cuts a fuel supply to the engine when a cutting condition at boom lowering is satisfied, the cutting condition at boom lowering being defined to include that an operating amount of the boom operation lever is greater than or equal to a first threshold, and resumes the fuel supply to the engine when the cutting condition at boom lowering stops being satisfied or when the actual rotation speed of the engine becomes less than a second threshold.

2. The drive system of a construction machine according to claim 1, wherein the pump is connected to a tank by a suction line provided with a check valve, and the hydraulic circuit includes a regenerative line that leads the pressurized oil discharged from the boom cylinder at boom lowering to a portion of the suction line downstream of the check valve.

3. The drive system of a construction machine according to claim 1, wherein the hydraulic circuit includes a regenerative motor that is coupled to the pump such that a torque of the regenerative motor is transmittable to the pump, the regenerative motor being rotated by the pressurized oil discharged from the boom cylinder at boom lowering.

4. The drive system of a construction machine according to claim 1, wherein the hydraulic circuit includes a turning motor that is supplied with the hydraulic oil from the pump, the hydraulic circuit being configured such that energy is regenerated as motive power owing to the pump being driven by pressurized oil discharged from the turning motor at turning deceleration, the drive system further comprises a turning operation device including a turning operation lever, at turning deceleration, the controller cuts the fuel supply to the engine when a cutting condition at turning deceleration is satisfied, the cutting condition at turning deceleration being defined to include that an operating amount of the turning operation lever is less than or equal to a third threshold, and resumes the fuel supply to the engine when the cutting condition at turning deceleration stops being satisfied or when the actual rotation speed of the engine becomes less than the second threshold.

5. The drive system of a construction machine according to claim 4, wherein the cutting condition at turning deceleration is defined to further include that a turning speed is higher than a setting value.

6. The drive system of a construction machine according to claim 4, wherein the controller includes an engine control unit and a pump control unit, the engine control unit controlling the fuel injection valve, the pump control unit controlling at least one device included in the hydraulic circuit, the engine control unit transmitting an actual rotation speed signal of the engine to the pump control unit, and the pump control unit:

transmits a fuel supply cuttable signal to the engine control unit when the cutting condition at turning deceleration is satisfied; and stops transmitting the fuel supply cuttable signal when the cutting condition at turning deceleration stops being satisfied or when the actual rotation speed of the engine becomes less than the second threshold.

7. The drive system of a construction machine according to claim 1, wherein the controller includes an engine control unit and a pump control unit, the engine control unit controlling the fuel injection valve, the pump control unit controlling at least one device included in the hydraulic circuit, the engine control unit transmitting an actual rotation speed signal of the engine to the pump control unit, and the pump control unit:

transmits a fuel supply cuttable signal to the engine control unit when the cutting condition at boom lowering is satisfied; and stops transmitting the fuel supply cuttable signal when the the cutting condition at boom lowering stops being satisfied or when the actual rotation speed of the engine becomes less than the second threshold.

8. A drive system of a construction machine, comprising:

a controller that controls a fuel injection valve provided on an engine, such that an actual rotation speed of the engine is adjusted to a setting rotation speed;

a hydraulic circuit that includes a pump and a turning motor, the pump being driven by the engine, the turning motor being supplied with hydraulic oil from the pump, the hydraulic circuit being configured such that energy is regenerated as motive power owing to the pump being driven by pressurized oil discharged from the turning motor at turning deceleration; and a turning operation device including a turning operation lever, wherein at turning deceleration, the controller cuts a fuel supply to the engine when a cutting condition at turning deceleration is satisfied, the cutting condition at turning deceleration being defined to include that an operating amount of the turning operation lever is less than or equal to a first threshold, and resumes the fuel supply to the engine when the cutting condition at turning deceleration stops being satisfied or when the actual rotation speed of the engine becomes less than a second threshold.

9. The drive system of a construction machine according to claim 8, wherein the cutting condition at turning deceleration is defined to further include that a turning speed is higher than a setting value.

10. The drive system of a construction machine according to claim 8, wherein the controller includes an engine control unit and a pump control unit, the engine control unit controlling the fuel injection valve, the pump control unit controlling at least one device included in the hydraulic circuit, the engine control unit transmitting an actual rotation speed signal of the engine to the pump control unit, and the pump control unit:

transmits a fuel supply cuttable signal to the engine control unit when the cutting condition at turning deceleration is satisfied; and stops transmitting the fuel supply cuttable signal when the cutting condition at turning deceleration stops being satisfied or when the actual rotation speed of the engine becomes less than the second threshold.

* * * * *